United States Patent [19]

Chang

[11] Patent Number: 4,809,582

[45] Date of Patent: Mar. 7, 1989

[54] OUTER LAYER DRUMHEAD STRUCTURE

[76] Inventor: Cheng-Hui Chang, 383, Fu Hsing Rd., 1st Sec. Taichung, Taiwan

[21] Appl. No.: 200,107

[22] Filed: May 31, 1988

[51] Int. Cl.[4] ..... G10D 13/02

[52] U.S. Cl. ..... 84/414

[58] Field of Search ..... 84/411–418

[56] References Cited

U.S. PATENT DOCUMENTS

| | | | |
|---|---|---|---|
| 729,936 | 6/1903 | Heybeck | 84/414 |
| 2,018,182 | 10/1935 | Logan | 84/414 |
| 3,250,169 | 5/1966 | Stone et al. | 84/414 |
| 3,362,275 | 1/1968 | Koishikawa | 84/411 R |
| 4,616,552 | 10/1986 | Jang | 84/414 |

*Primary Examiner*—Lawrence R. Franklin

*Attorney, Agent, or Firm*—Varndell Legal Group

[57] ABSTRACT

The present invention is to provide an improved outer layer drumhead structure and more particularly a drumhead structure to prevent from loosening while beating, and to keep the tonality of drumbeat be more tight and accurate, of which the structure is confined by means of the arrangement of a drumhead tetoron cloth and a frame of aluminum rod and aluminum groove channel in a way that the drumhead tetoron cloth is encircled between the aluminum rod and the aluminum groove channel with the outer layer of the drumhead tetoron cloth extending to a reasonable distance along the curved surface so as to provide a better construction against beating and also to give a better tonality while beating.

1 Claim, 2 Drawing Sheets

OUTER LAYER DRUMHEAD STRUCTURE

BACKGROUND AND SUMMARY OF THE INVENTION

Drum is the soul of musical instrument, which directs the rhythm of a melody by means of its drumbeat, and further, the drumbeat can encourage people's spirit. In jazz music, there are several kinds of drums being performed, such as bass drum, snare drum, tambourinem, and tom tom etc., however, the structure of which and the material used are almost the same. For the manufacturing of such kinds of drums, the technique required is to provide a drum with better tonality and timbre and the key point to provide better tonality and timbre is determined by means of the minimum volume of vibration noise while beating. Therefore, in addition to the material used or the single layer of double-layer of drumhead constructed, the measure to affix the drumhead and the angle provided in the affixture are more than important. The present inventor in endeavoring in the improvement of the drumhead structure and one of his invention has been approved in U.S.A. with a Letter U.S. Pat. No. 4,616,552. As shown in the attached FIGS. 1, 2, and 3, the drumhead is completed by means of a central plane radially extending outward to a proper distance from the side frame and turning downward by pressure to form a small curved surface, said small curved surface is then extending horizontally for a proper distance from its terminal edge and then being pressed downward to form a large curved surface, said large curved surface is then arranged to connect with the side frame of the drum. The connection of the large curved surface with the side frame of the drum is as illustrated in FIGS. 2 and 3 wherein said side frame is composed of an internal aluminum rod and an external aluminum channel and the terminal edge of the drumhead is encircled between said external aluminum channel and said internal aluminum rod. Although some improvement has been achieved, this arrangement of the drumhead is still not satisfactory and there is still problems pending unsettled: (1) the drumhead is easy to get loosened and dropped while beating due to heavy vibration and the displacement of the aluminum rod against aluminum channel; (2) the loosening of the drumhead due to bad connection with the side frame, the tonality and timbre are greatly interfered while beating.

In view of the said problems, the present inventor has finally created the present invention to provide a better structure to connect the drumhead and the side frame by means of a tetoron cloth drumhead thus encircled around the aluminum rod and aluminum channel is then extending for a distance to form a curved surface as an outer layer of drumhead to strengthen its connection with the drum so as to prevent any loosing problem during beating. Another object of the present invention is to provide a better tonality and timbre of drumbeat by means of the arrangement of the double-layer curved surface.

DETAILED DESCRIPTION OF THE PREFERRED EMBODIMENT

Figure 1:
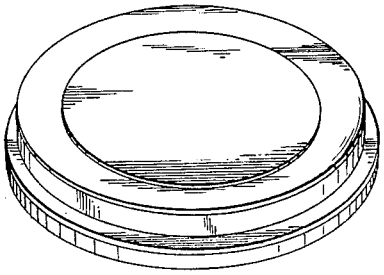
FIG. 1 is a perspective assembly view of the drumhead and the side frame of the present invention.
Figure 2:
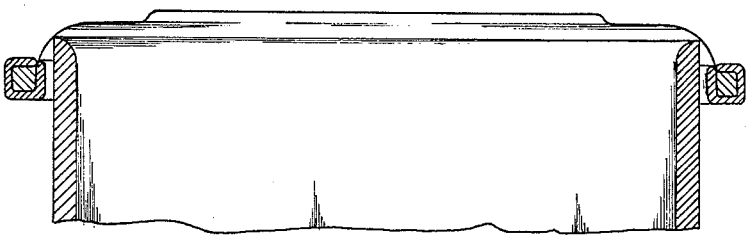
Fig. 2 PRIOR ART
FIG. 2 is a sectional assembly view of the drumhead and the side frame of the conventional drums.
Figure 3:
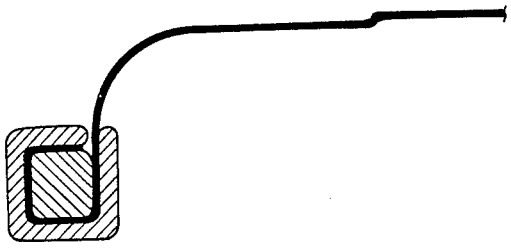
Fig. 3 PRIOR ART
FIG. 3 is a sectional view of the connection between drumhead and side frame of the conventional drums.
Figure 4:
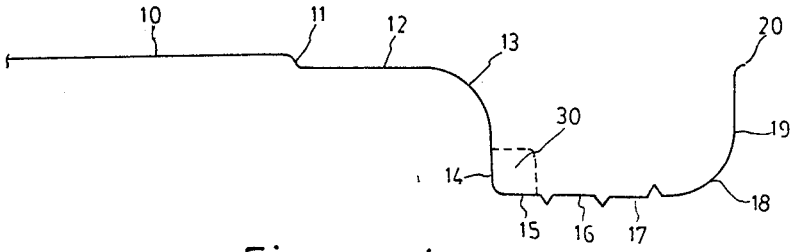
FIG. 4 illustrates the lateral configuration of the embodiment of the present invention.

The present invention relates to an improved outer layer drumhead structure and more particularly a drumhead structure which can prevent from loosening and give better tonality and timbre of drumbeat while beating.

As shown in the sectional view of the tetoron cloth drumhead, the drumhead is formed by heat press and it comprises the drum cover surface 10, the small curved surface 11, the large curved surface 13, and the encircled four surfaces 14, 15, 16, 17 to encurcle around the internal aluminum rod 30, and the curvature of the outer layer of circular surface 18 is designed to be equal or larger than the larger curved surface 13, such that the plane surface 19 and the plane surface 12 can be tightly in contact after folding and the curved body 20 at the terminal end is affixed to the small curved surface 11. The configuration after connection is as shown in FIG. 5.

Figure 5:
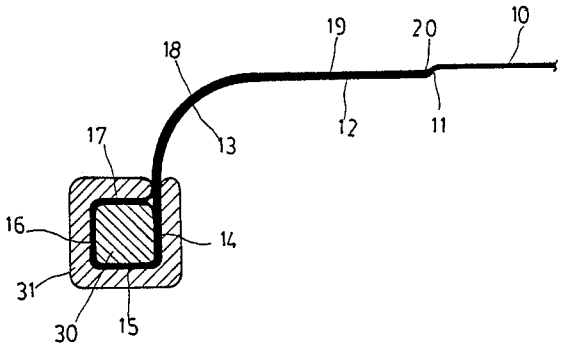
FIG. 5 illustrates a single side connection structure of the present invention.

Referring to FIG. 5, after assembly of the present invention, the encircled four surfaces 14, 15, 16, 17 are arranged between the internal aluminum rod 30 and the external aluminum channel 31, and characterized in that the circular surface 18 and the plane surfaces 19 and 12 are tightly affixed on the curved surface 13, plane surface 12 and small curved surface 11 to strengthen the connection of the tetoron cloth drumhead with the side frame of the drum to reduce the noise resulted from vibration so as to prevent loosening of the drumhead and to provide a better tonality and timbre of drumbeat.

Some others may suppose that the provision of a toothed aluminum rod could keep the drumhead be firmed affixed thereto to prevent loosening. However, according to the analysis and experimentation of the present inventor, the surface finish of a leather drumhead is as smooth as a glass and the tenacity of which is very strong, thereby the toothed aluminum rod will be unable to keep the drumhead be free from loosening after a period of beating.

On the whole design of the present invention, when the central plane surface of the drum cover surface 10 receives beating, except of the normal drumbeat, the vibrational weave irregularly extending outward is concentrated by the small curved surface 11 and then absolutely absorbed by the double-layer affixture of the plane surfaces 19 and 12 so that a better tonality and timbre of drumbeat can be obtained.

In general, the present invention is to make use of the original structural design to cover a drumhead by means to encircle around the internal aluminum rod and the external aluminum channel with an expanded curved surface and plane surface to tightly affix on the curved surface and plane surface of the firt layer of the drumhead so as to prevent the drumhead from loosening and to provide a better tonality and timbre of drumbeat by reducing the noise of the drumbeat while beating.

I claim:

1. A drumhead comprising:

a Tetoron cloth drumhead having a planar surface, a curved surface, and a periphery; and a circular frame consisting of an aluminum rod having an external surface and an aluminum channel member having an internal surface, said periphery having a portion encircling said rod external surface within said channel member internal surface and being affixed to said curved surface and the portion of said periphery between said frame and said curved surface.

* * * * *